US005596896A

United States Patent [19]

Snell

[11] Patent Number: 5,596,896

[45] Date of Patent: Jan. 28, 1997

[54] METHODS AND APPARATUS FOR EFFECTING DOMAIN REFINEMENT OF ELECTRICAL STEELS

[75] Inventor: David Snell, Gwent, Great Britain

[73] Assignee: Orb Electrical Steels Limited, Great Britain

[21] Appl. No.: 335,847

[22] PCT Filed: May 12, 1993

[86] PCT No.: PCT/GB93/00971

§ 371 Date: Nov. 7, 1994

§ 102(e) Date: Nov. 7, 1994

[87] PCT Pub. No.: WO93/23576

PCT Pub. Date: Nov. 25, 1993

[30] Foreign Application Priority Data

May 13, 1992 [GB] Great Britain ..... 9210292

[51] Int. Cl.[6] ..... B21B 1/00

[52] U.S. Cl. ..... 72/75; 72/215; 72/220; 148/111

[58] Field of Search ..... 148/111, 120; 72/75, 215, 220

[56] References Cited

U.S. PATENT DOCUMENTS

| | | | |
|---|---|---|---|
| 1,240,791 | 9/1917 | Czajka | 72/75 |
| 2,048,598 | 7/1936 | Christiansen | 72/75 |
| 2,486,844 | 11/1949 | Hercik | 72/75 |
| 4,318,758 | 3/1982 | Kuroki et al. | 148/111 |
| 4,513,597 | 4/1985 | Kimoto et al. | 72/53 |
| 4,770,720 | 9/1988 | Kobayashi et al. | 148/111 |

FOREIGN PATENT DOCUMENTS

| | | | |
|---|---|---|---|
| 59-59828 | 4/1984 | Japan | 72/75 |
| 6-220539 | 8/1994 | Japan | 148/111 |

*Primary Examiner*—John Sheehan
*Attorney, Agent, or Firm*—Bacon & Thomas

[57] ABSTRACT

Apparatus for effecting domain refinement of electrical steels comprises an assembly of an array of rotatable members (2) mounted within a supporting structure (3) and movable into direct contact with the surface of a strip or sheet of electrical steel to create lines of local plastic deformation which extends generally across the width of the steel to effect domain refinement thereof. Relative linear movement is imparted between the member and the steel strip or sheet.

10 Claims, 10 Drawing Sheets

METHODS AND APPARATUS FOR EFFECTING DOMAIN REFINEMENT OF ELECTRICAL STEELS

BACKGROUND OF THE INVENTION

1. Field of the Invention

This invention relates to a method of and apparatus for effecting domain refinement of electrical steels and especially, but not exclusively, high-permeability grain-oriented electrical steels. In particular, but not exclusively, the invention concerns apparatus operable to produce within steel strip and sheet lines of local plastic deformation which refine the strip or sheet's domain structures and reduce power loss without causing damage to the insulation coating of the strip or sheet thereby removing the need for recoating after treatment.

2. Discussion of the Prior Art

It is known that the magnetic properties of grain-oriented electrical steels can be enhanced by processing in a known manner which effects preferential alignment of grains within the steel.

One problem associated with known techniques for producing enhanced magnetic properties is that effecting optimum grain alignment tends simultaneously to produce larger than optimum grain sizes, this resulting in higher power losses than would have been the case with smaller grain sizes and domain wall spacings.

Known techniques for effecting domain refinement by creation of artificial grain boundaries include mechanical methods, lasers or high voltage discharge systems.

Hitherto, mechanical methods have not been found to be susceptible to commercial use with the result that relatively expensive laser systems are conventionally employed commercially. A relatively inexpensive spark ablation method (high voltage discharge system) is being utilised but this system tends to be rather slow for successful commercial use.

Although domain refinement can be achieved by a method known as mechanical ball scratching in which very small balls of diameter of the order of 0.7 mm are employed which are forced into contact with the surface of a sheet under treatment, the method is difficult to maintain and operate on a commercial basis. Also, scratching of the surface of the steel occurs, and recoating of the steel after treatment is necessary.

SUMMARY OF THE INVENTION

This invention sets out to provide a method and apparatus for refining the domain structure of high permeability grain-oriented electrical steels in which high localised pressure is applied to the surface of the steel to produce lines of plastic deformation in the form of lines spaced approximately 5 mm apart in directions generally perpendicular to the rolling direction of the sheet or strip.

A method of effecting domain refinement of a strip or sheet of electrical steel which is characterised by the steps of creating in the strip lines of local plastic deformation by moving a plurality of resiliently mounted spaced balls of diameter of at least 10 mm in to contact therewith.

Apparatus for effecting domain refinement of electrical steels comprising an assembly of an array of rotatable members mounted within a supporting structure and movable into direct contact with the surface of a strip or sheet of electrical steel to create lines of local plastic deformation which extend substantially across the width of the strip or sheet to effect domain refinement thereof, and means operable to impart relative linear movement between the members and the steel strip or sheet, the apparatus being characterised in that the rotatable members are spaced one from another such that the spacing between the lines of plastic deformation created by the rotatable members is at least 5 mm and in that means are provided for resiliently biassing the rotatable members away from the supporting structure.

The rotatable member preferably comprises a ball of relatively large diameter in contact with a relatively large number of smaller balls, which is resiliently biased away from its supporting structure and into contact with the surface of the steel strip or sheet. Each ball may be produced from any suitable hard wearing material, for example chrome steel or silicon nitride. It is preferable that the electrical steel is supported on a relatively hard surface/substrate during the domain refinement process. The substrate may comprise or be coated with a resin bonded material or may or comprise a stainless steel plate. The substrate is preferably wider than the strip or sheet of electrical steel to be treated. In an alternative construction the substrate comprises a large diameter roller or a continuous belt.

The method and apparatus described in the preceding three paragraphs are readily amenable to commercial production and are comparatively cheap to operate. Additionally, the apparatus is relatively easy to maintain with no difficult adjustments to make during operation of the same. Further, recoating of the steel after treatment is not necessary and the process is amenable to continuous strip movement or strip indexing methods of production. Fast process speeds are also attainable.

BRIEF DESCRIPTION OF THE DRAWINGS

The invention will now be described by way of example only with reference to the accompanying diagrammatic drawings, in which.

DETAILED DESCRIPTION OF THE PREFERRED EMBODIMENTS

Figure 1:
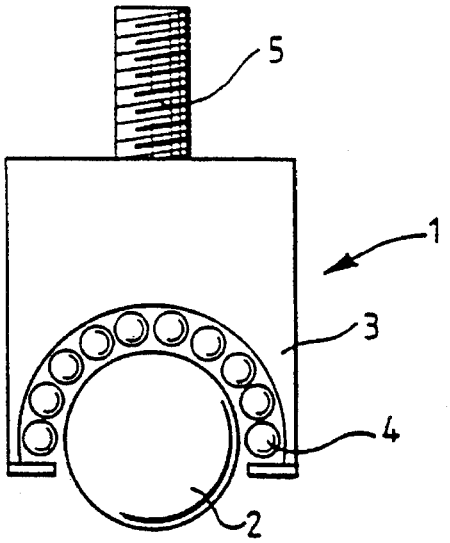
FIG. 1 is a sectional view of apparatus in accordance with the invention.

The apparatus illustrated in FIG. 1 comprises an assembly 1 of a chrome-steel ball 2, typically of a diameter of between 12 and 32 mm, mounted for rotation within a steel support casing 3. Other diameter balls may be employed, these ranging from 10 mm to 50 mm in diameter. Also, the balls may be produced from other hard-wearing materials other than chrome-steel, e.g. silicon nitride. Bearings 4 are positioned between the opposed surfaces of the ball 2 and casing 3 to create a low friction assembly allowing the relatively large ball freely to rotate over the surface of a steel sheet under treatment. A threaded shaft 5 is upstanding from the casing for appropriate attachment to a carriage or the like.

As will be seen from FIG. 2, the assembly when used in an indexing mode, may include a plurality of chrome-steel ball units 2, the relative positions of these on the respective support carriage being a matter of choice depending upon the length of the sheet or strip to be treated and its manner of movement relative to the assembly. In the embodiment illustrated in FIG. 2*a*, the positions of several chrome-steel ball units 2 are shown, the balls of each row being offset with respect to its neighbours such that the spacing between lines created at right angles to the rolling direction of the strip on traverse are of the order of 5 mm. In this embodiment, in use the assembly of the balls and casing are caused to traverse the full width of the strip which is stationary, the latter then being indexed laterally in the direction indicated by arrow 'A' by a distance equivalent to the length taken up by the ball units employed. Conventional linear motion units may be employed as the traverse drive mechanism.

Figure 2A:
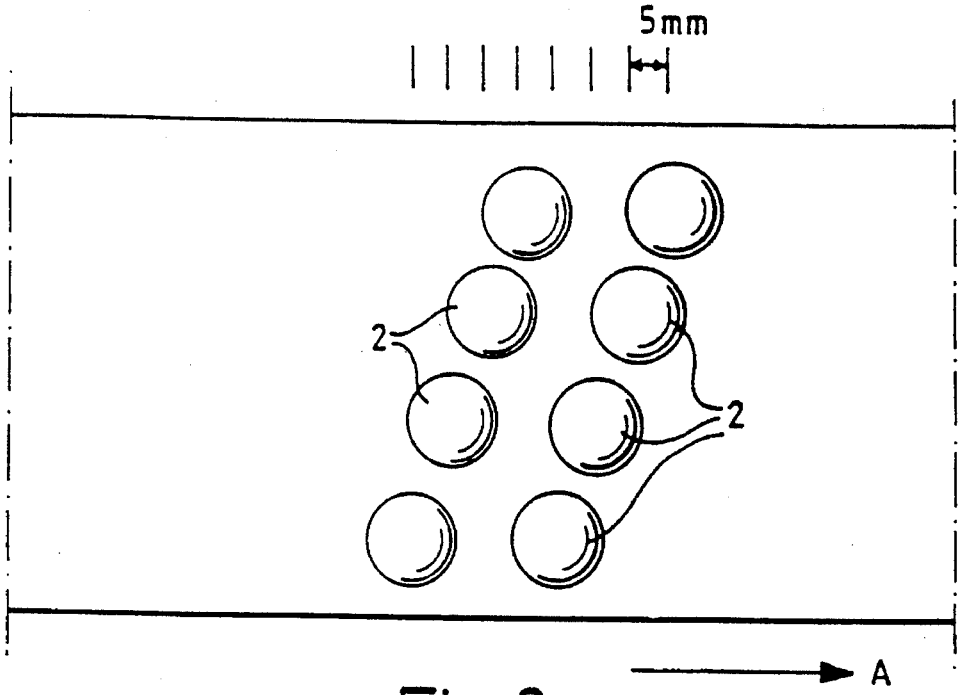
FIGS. 2*a*, 2*b*, 2*c*, and 2*d* illustrate alternative embodiments of apparatus in accordance with the invention.
Figure 2B:
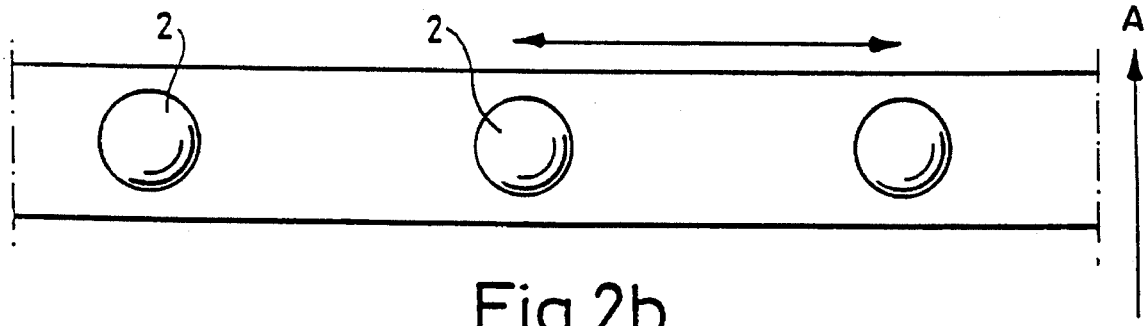

In the embodiment illustrated in FIG. 2*b*, an assembly of several side-by-side chrome-steel ball units is employed, the ball units being caused to traverse to a limited extent in a reciprocating manner at an appropriate speed across the width of a continuously or periodically moving strip of high-permeability electrical steel to create lines of local plastic deformation spaced typically 5 mm apart. The direction of strip movement is indicated again by arrow 'A'.

Figure 2C:
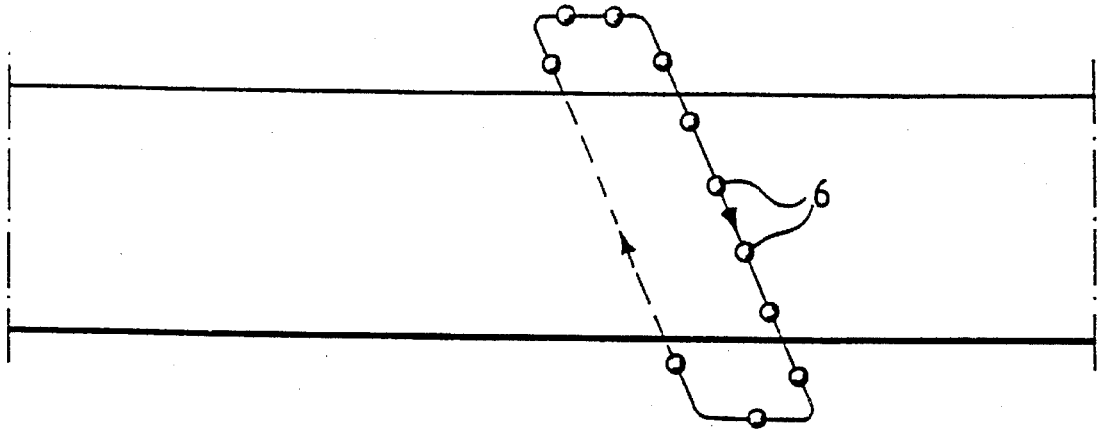
Figure 8:
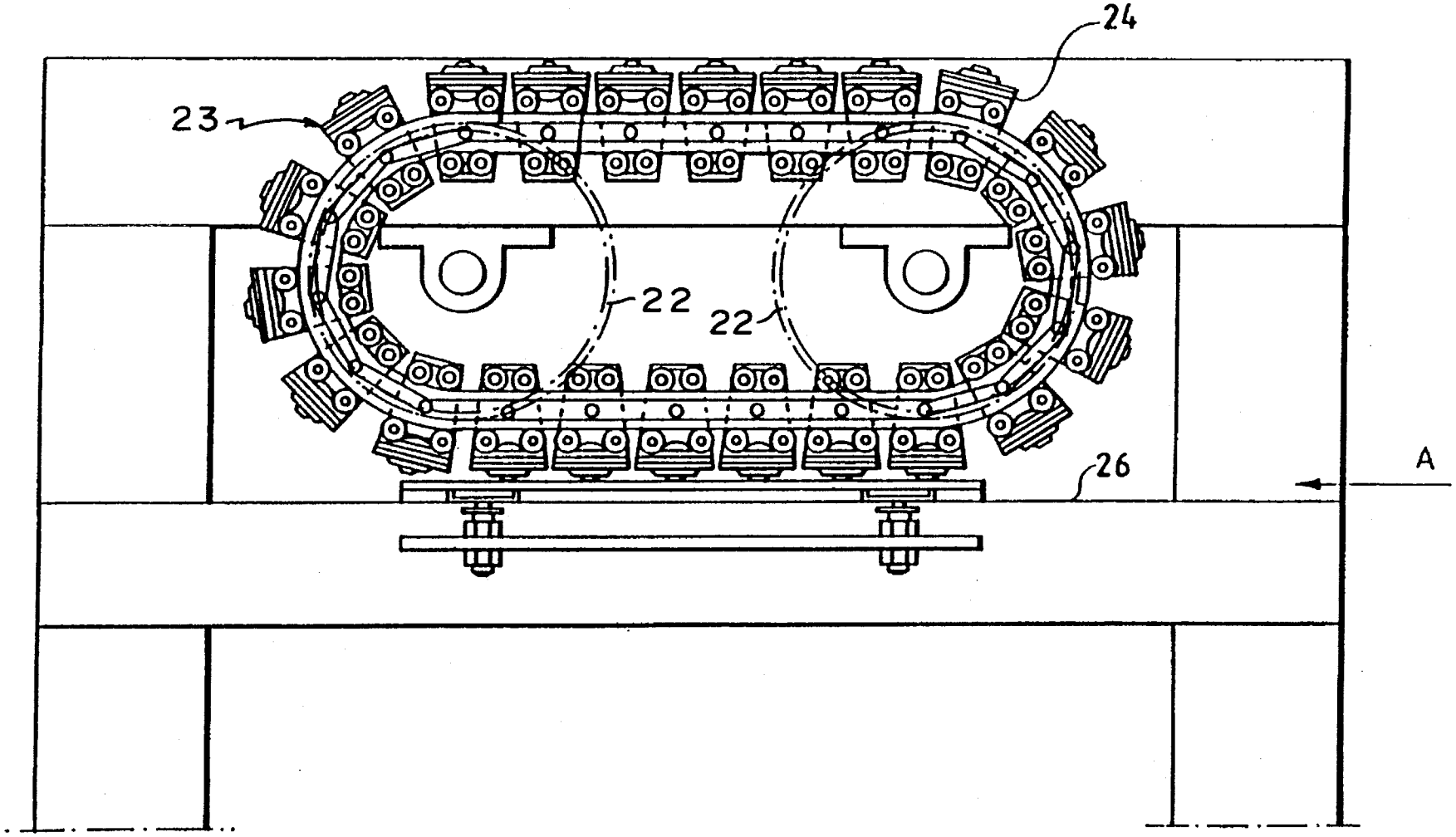
FIGS. 8 and 9 are respectively a plan view and a side view in section of still further apparatus in accordance with the invention and FIGS. 10A and 10B illustrate the domain structure of refined steel treated in accordance with the invention.

In the arrangement illustrated in FIG. 2*c*, the assembly comprises an arrangement of chrome steel balls 6 which are supported so as to traverse continuously across the width of the upper or lower surface of the strip whereby each ball unit creates lines of stress spaced approximately 5 mm apart normal to the rolling direction of the strip. A lower or upper return path is provided in which the ball units do not come into contact with the strip surface. A typical production arrangement in accordance with this particular embodiment is illustrated in FIG. 8.

Figure 2D:
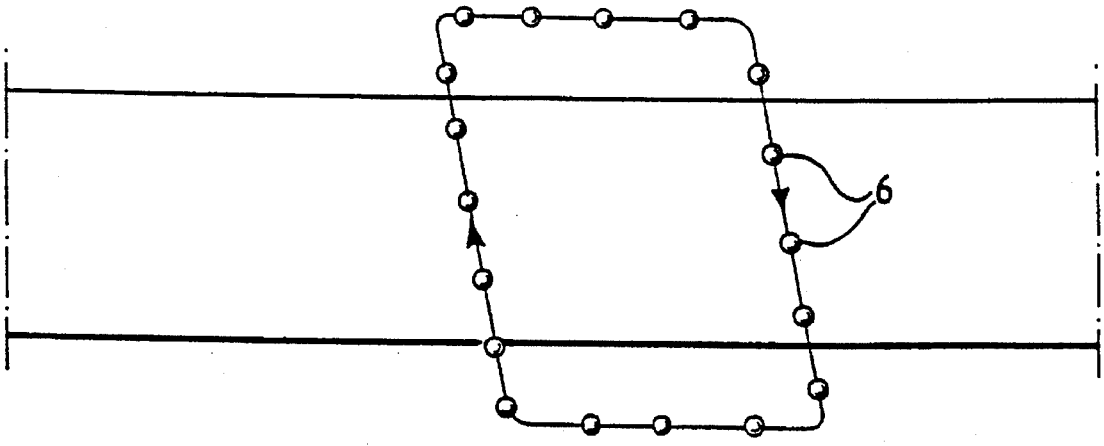

In the embodiment of FIG. 2*d*, chrome-steel ball units are again employed, these being made to traverse continuously the strip in a circular-like manner whereby slightly curved lines of stress are created across the strip width creating the domain refinement on traversing the strip in one direction and missing the strip on the return path. Several circular motion arrangements may be employed instead of one in order to reduce the size of the assembly. A typical production arrangement in accordance with this particular embodiment is illustrated in FIGS. 4, 5, 6 and 7.

Figure 3:
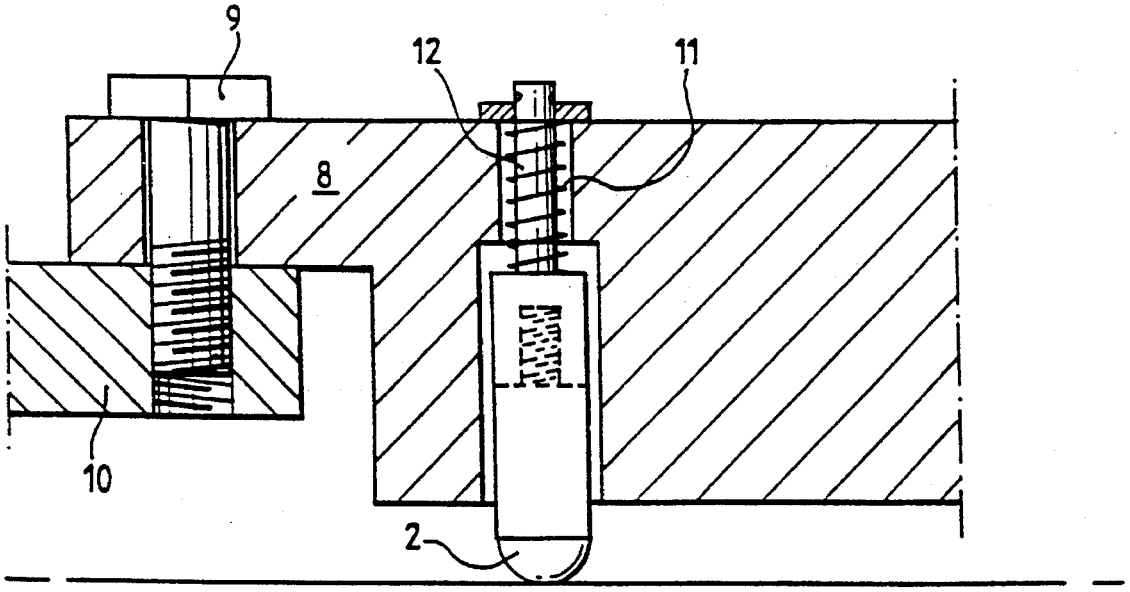
FIG. 3 is a sectional view of a further embodiment of apparatus in accordance with the invention.

As will be seen from FIG. 3, each assembly 1 is supported within a carriage 8 secured by a bolt 9 to a drive member 10. A spring 11 is located about a non-threaded attachment shaft 12 to urge the ball unit 2 into contact with the strip or sheet under treatment. Alternatively, a pneumatic method of urging the ball unit 2 into contact with the strip or sheet may be employed.

Figure 4:
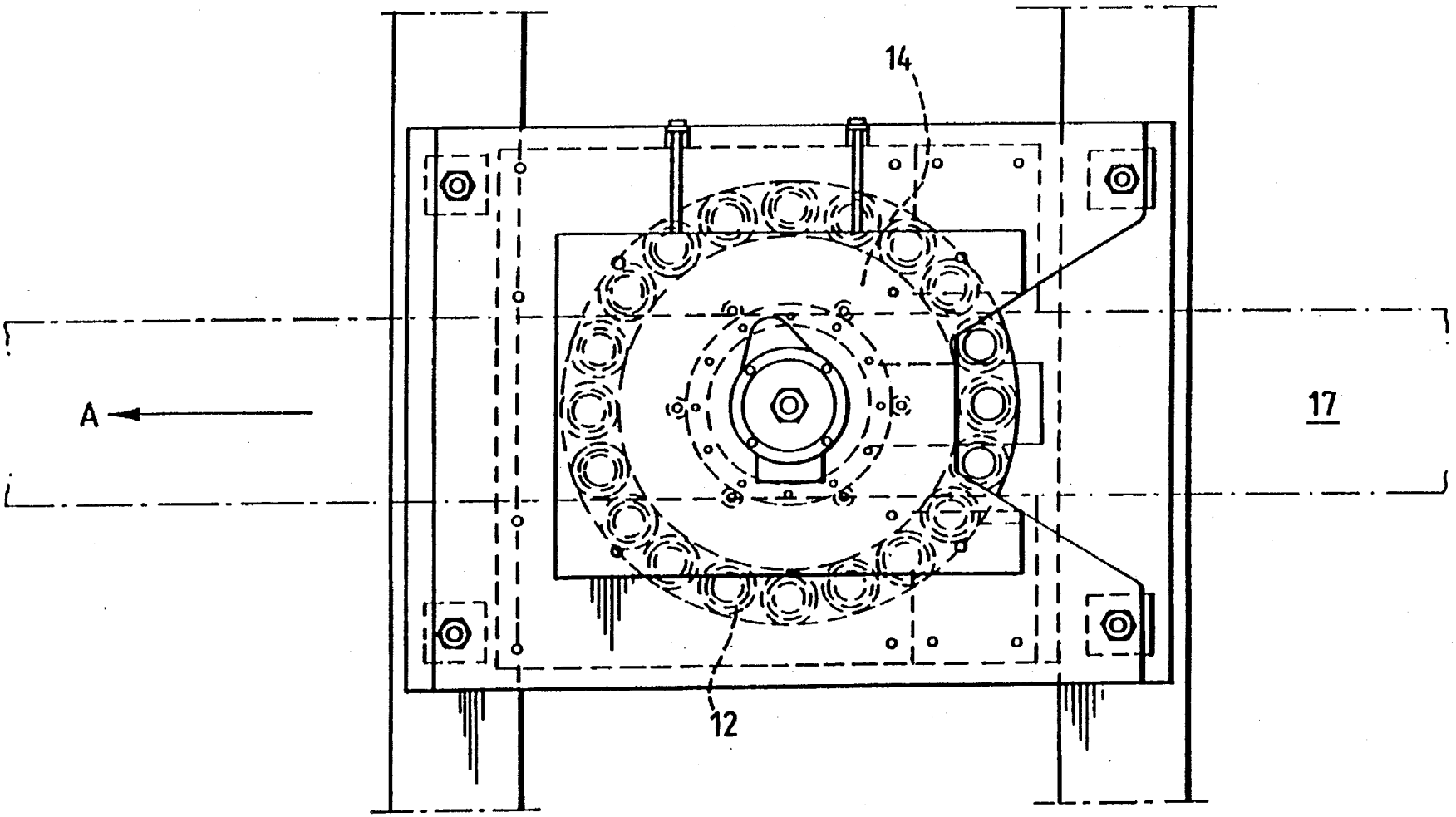
FIGS. 4 and 5 are respectively plan and side views of alternative apparatus in accordance with the invention.
Figure 5:
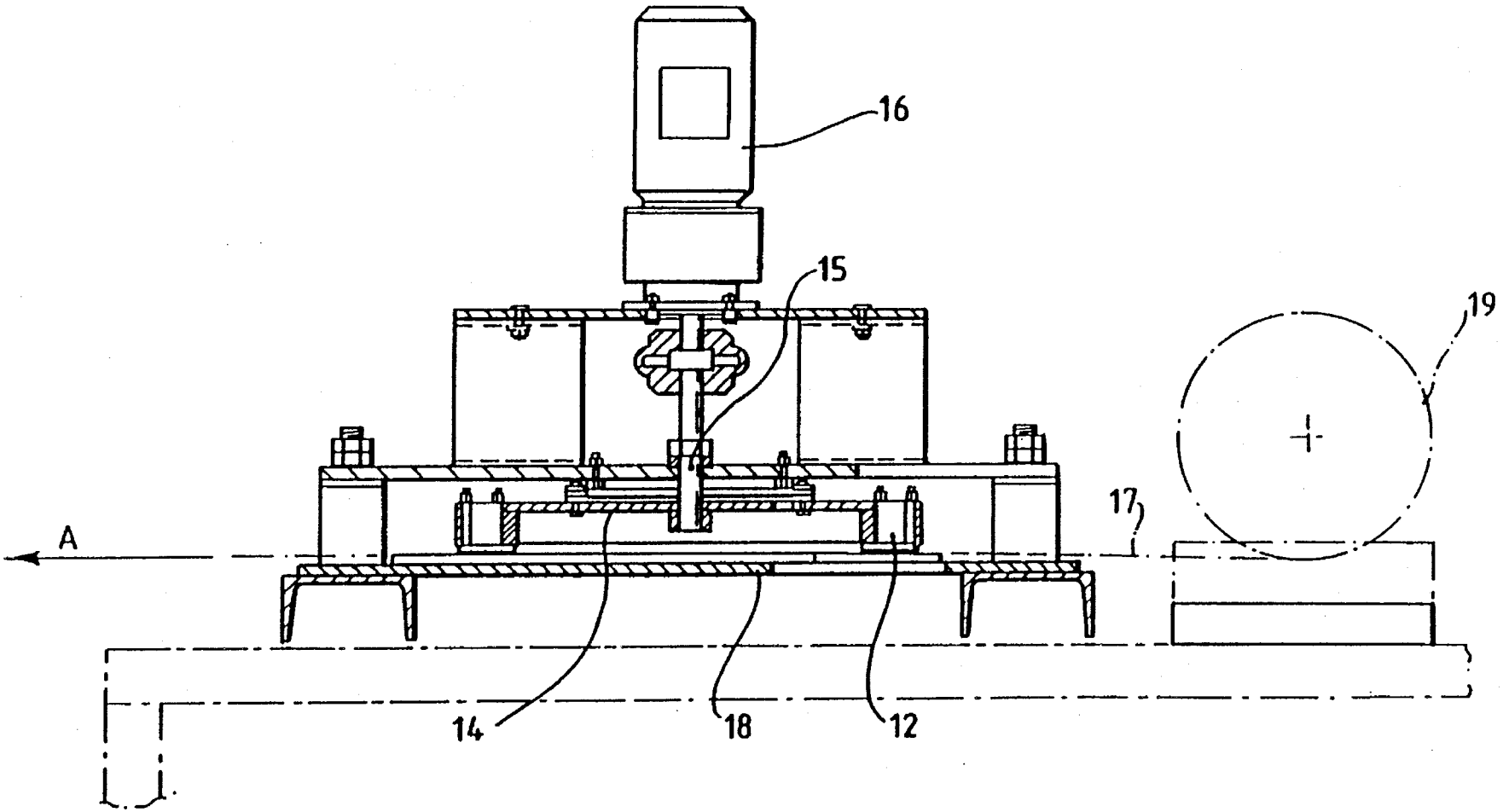

The apparatus illustrated in FIGS. 4 and 5 comprises a circular array of chrome-steel balls 12 supported within a rotable carriage 14 including an upstanding shaft 15 rotatable by an electric motor 16. The strip is indicated by reference numeral 17 and its intended direction of movement is indicated by arrow 'A'. A flat-surfaced steel substrate 18 is positioned below the strip 17. As will be seen from FIG. 4, the strip 17 is masked from the strip surface during one of its paths across the strip width.

In operation, steel strip from a coil 19 moves continuously over the substrate 18 and into contact with the chrome-steel balls 12 to create the required lines of stress. The speeds of movement of the strip 17 and the carriage 14 are selected to ensure that the lines of stress created lie generally transverse of the strip.

Figure 6:
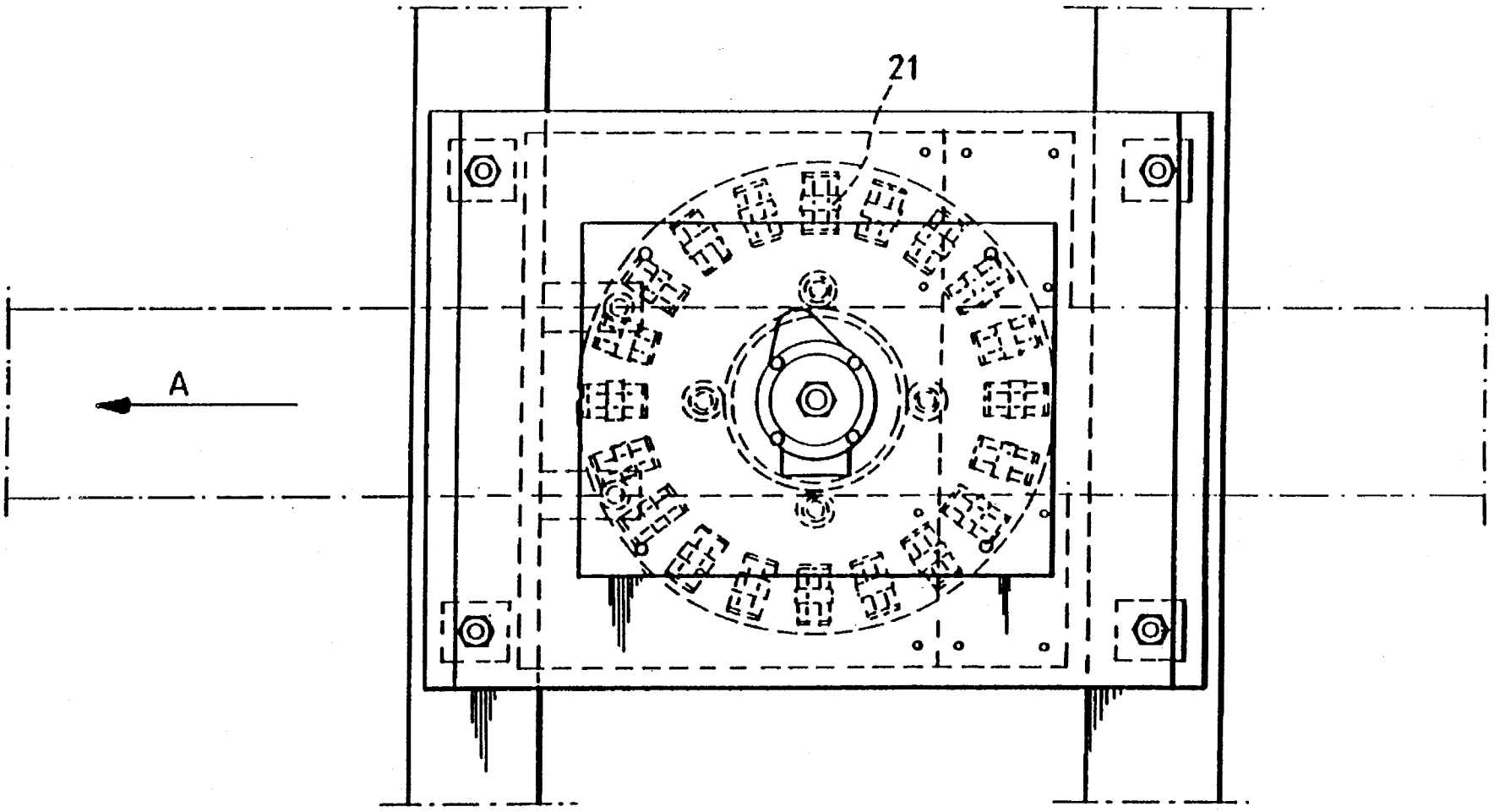
FIGS. 6 and 7 are respectively a plan view and a side view in section of further apparatus in accordance with the invention.
Figure 7:
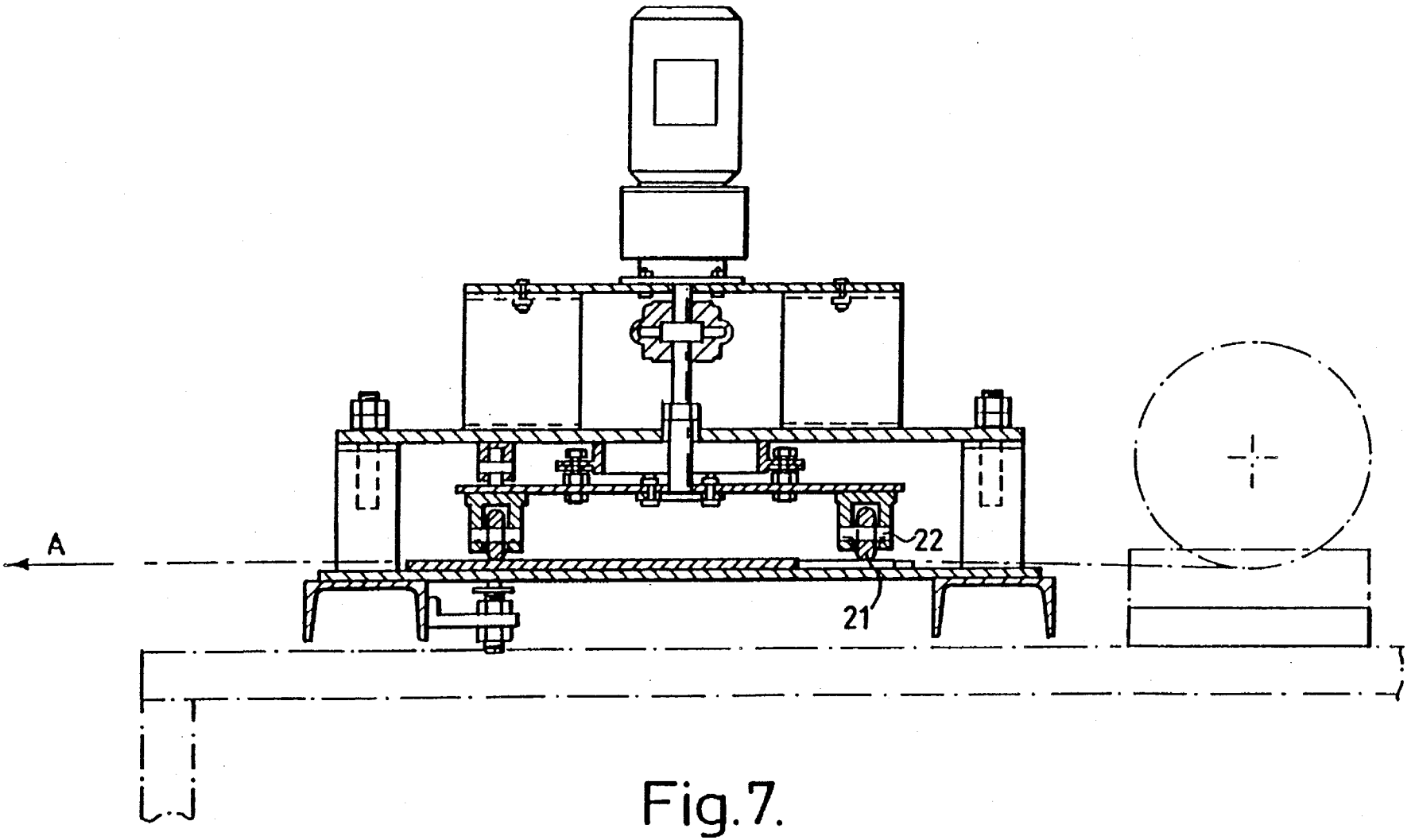

The apparatus illustrated in FIGS. 6 and 7 is similar to that illustrated in FIGS. 4 and 5 and like integers have been given the same reference numerals. In this embodiment, however, the chrome-steel balls 12 are replaced by chrome-steel rings 21 mounted on shafts 22. In other respects, the apparatus illustrated in FIGS. 6 and 7 is the same as that illustrated in FIGS. 4 and 5.

Figure 9:
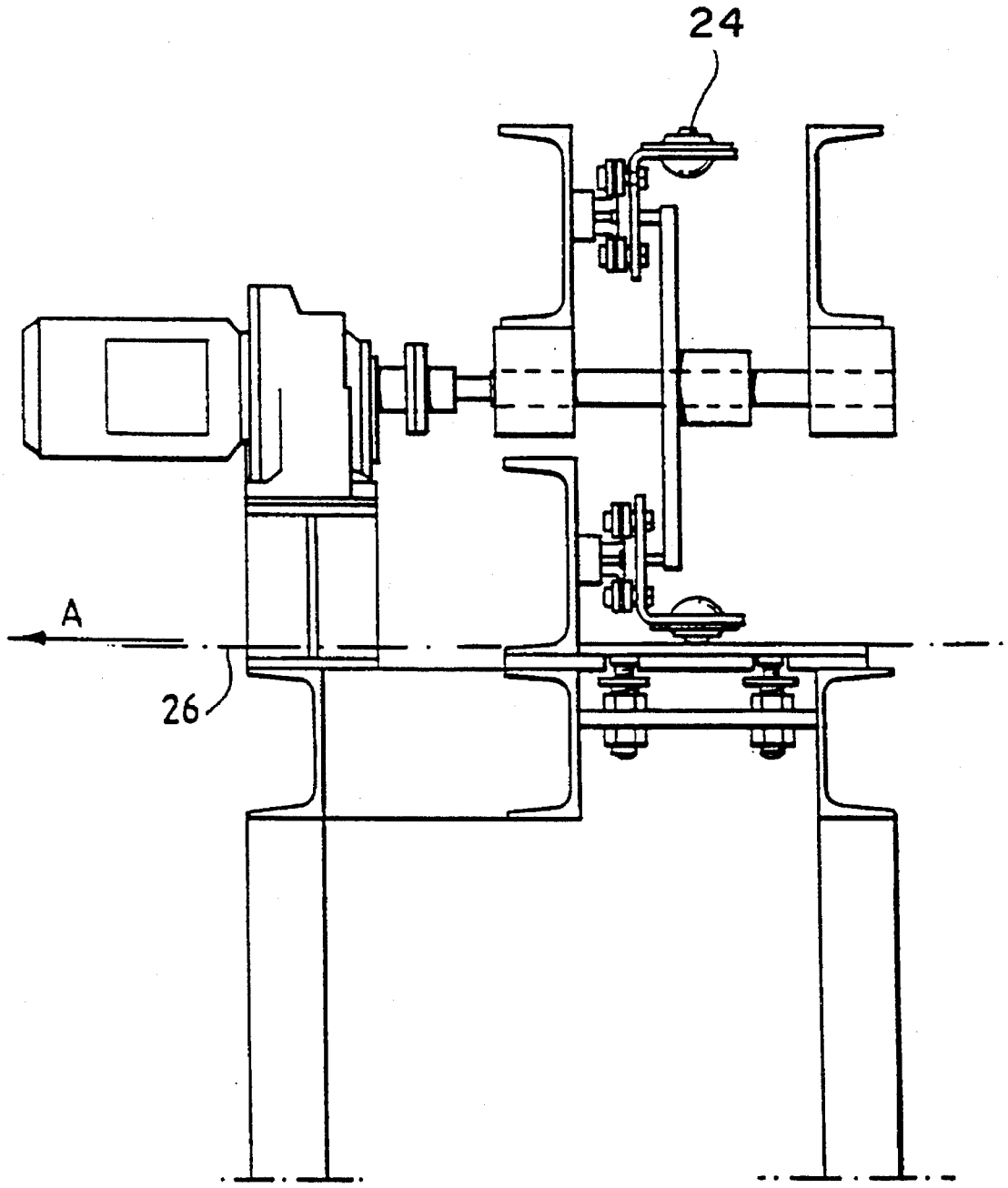

The apparatus illustrated in FIGS. 8 and 9 comprises a pair of rotatable wheels 22 about which tracks an array of articulated carriages 23 each supporting a chrome-steel ball 24. The balls 24 are moved transversely across the width of the steel strip 17 moving continuously in the direction of arrow 'A'.

Figure 10B:
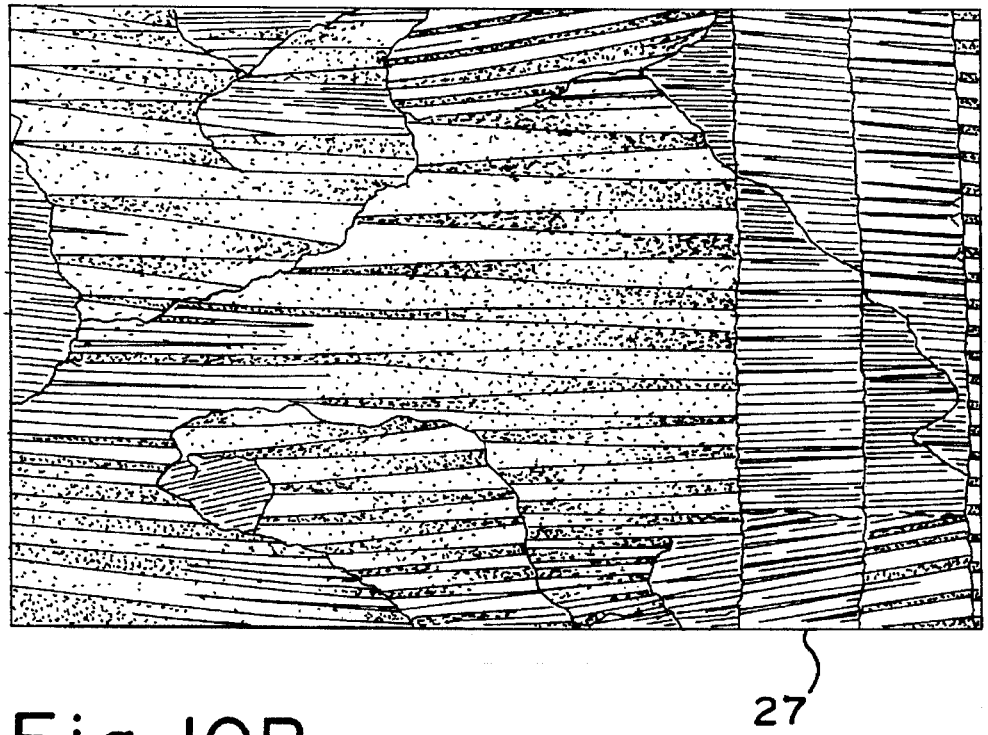
Figure 10A:
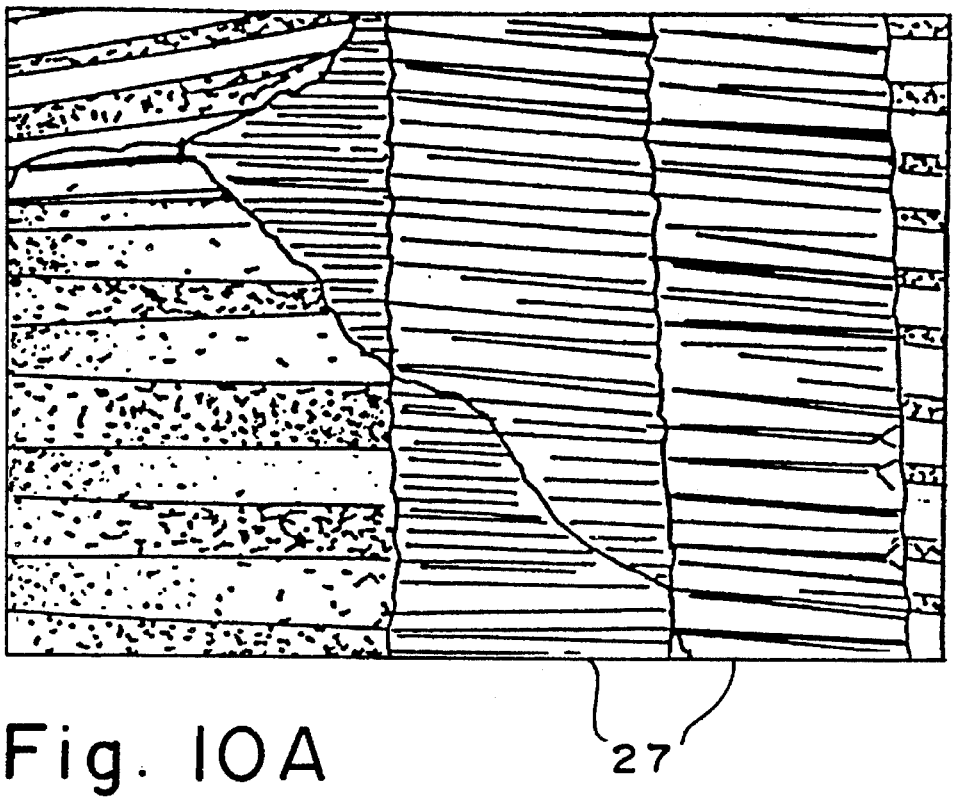

The refinement produced by the steel balls or rings of the present invention can be seen from FIGS. 10A and 10B. Clear areas of domain refinement are indicated by reference numbers 27.

Examples of initial trials conducted using apparatus in accordance with the invention will now be described by way of example only, Numerous samples of phosphate coated, finally processed high permeability grain-oriented electrical steel sheets, 610 mm×305 mm in size, were obtained and power loss (B=1.7 T, 50 $H_z$) and permeability (ÎlkA/m) values were determined.

A pilot line utilising a single ball unit, of diameter 12.5 mm, was used to treat these samples, the force applied by the spring arrangement being of the order of between 2 and 6 kgf (20–60N). Typical applied force values may be of the order of 4½ and 5½ kgf.

Application of this force created within the steel lines of stress enabling domain refinement to be clearly detectable on both sides of the sheets. The domain refinement achieved, observed using a magnetic domain viewer, can be clearly seen from FIGS. 10A and 10B. The insulation coatings of the samples were essentially undamaged during the trials with the result that the applied pressure lines were frequently difficult to observe, the effect however being clearly visible when using a domain viewer. It should be noted that effects of refinement achieved with spark ablation or lasers are not always clearly detectable on both sides of a treated sheet, whilst with the method described above refinement is almost always clearly detectable on both sides of the sheet.

Power loss and permeability values were then remeasured as was the insulation resistance by means of the dual electrode method of BS 6404, Part 2, appendix D. Typical values of loss reduction achieved and the effect of the treatment on permeability values are given in Table 1 below.

TABLE 1

Initial Results of Large Ball Unit Domain Refinement

| Sample | Initial Loss W/kg | Domain Refined Loss W/kg | % Loss Reduction | Initial BlkA/m (T) | Domain Refined BlkA/m (T) |
|---|---|---|---|---|---|
| 1 | 1.006 | 0.941 | 6.5 | 1.966 | 1.965 |
| 2 | 1.015 | 0.929 | 8.5 | 1.962 | 1.962 |
| 3 | 0.981 | 0.889 | 9.4 | 1.968 | 1.967 |

TABLE 1-continued

| Initial Results of Large Ball Unit Domain Refinement | | | | | |
|---|---|---|---|---|---|
| Sample | Initial Loss W/kg | Domain Refined Loss W/kg | % Loss Reduction | Initial BlkA/m (T) | Domain Refined BlkA/m (T) |
| 4 | 0.964 | 0.919 | 4.7 | 1.963 | 1.959 |
| 5 | 0.951 | 0.907 | 4.6 | 1.952 | 1.950 |
| 6 | 1.076 | 1.014 | 5.8 | 1.910 | 1.903 |
| 7 | 1.005 | 0.937 | 6.8 | 1.958 | 1.953 |
| 8 | 0.975 | 0.925 | 5.1 | 1.951 | 1.948 |
| 9 | 1.059 | 0.996 | 5.9 | 1.955 | 1.948 |
| 10 | 1.046 | 0.987 | 5.6 | 1.948 | 1.941 |

It can be seen from the tabulated results that for appropriate samples excellent values of loss reduction and final loss are achieved e.g. 9.4% loss reduction, final loss 0.889W/kg for 0.27 mm material.

The results show a small reduction in permeability value but this is insignificant. The range of results are typical of those achieved with the spark ablation system, results being dependent on, for example, the starting material grain size, orientation, and coating characteristics.

Insulation data given in Table 2 below indicates that use of the method of this invention does not degrade the insulation resistance significantly, making recoating unnecessary.

TABLE 2

| Insulation Resistance of Large Ball Unit Domain Refined Samples (Non-Recoated) | | |
|---|---|---|
| | % Number of Readings | |
| Sample | >10 ohms | >25 ohms |
| 4 | 100 | 95 |
| 5 | 90 | 90 |
| 6 | 90 | 90 |
| 11 | 100 | 90 |
| 9 | 100 | 85 |
| 14 | 90 | 85 |
| 15 | 90 | 75 |
| 13 | 80 | 70 |
| 16 | 100 | 100 |

The following examples are provided further to explain and exemplify features of the present invention.

EXAMPLE 1

Numerous samples of high permeability grain oriented electrical steel, 0.27 mm×610 mm×220 mm, were obtained and were domain refined using a range of applied forces to a ball unit 19.1 mm in diameter, the stress line spacing being 10 mm.

The results given in Table 3 clearly show the effect of increasing applied force on reduction of power loss e.g. an applied force of 3.39 kg results in only 0.51% loss reduction whereas increasing the applied force to 5.8 kg results in a loss reduction value of 6.88%.

A similar result can be seen in Table 3 when using a ball unit of diameter 31.8 mm in which an applied force of 4.94 kg results in 2.42% loss reduction whilst an applied force of 5.87 kg results in a loss reduction value of 5.24%.

TABLE 3

| Ball Unit Diameter (mm) | Applied Force (kg) | % Loss Reduction |
|---|---|---|
| 19.1 | 2.18 | 0.61 |
| | 2.78 | 0.82 |
| | 3.39 | 0.51 |
| | 4.0 | 1.23 |
| | 4.6 | 2.04 |
| | 5.2 | 4.76 |
| | 5.82 | 6.88 |
| 31.8 | 4.33 | 1.83 |
| | 4.94 | 2.42 |
| | 5.25 | 4.94 |
| | 5.55 | 4.03 |
| | 5.87 | 5.24 |
| | 6.15 | 4.84 |

EXAMPLE 2

Numerous samples of high permeability grain oriented electrical steel were obtained as in Example 1 and were domain refined using a range of applied force values, for a range of stress line spacings and for ball unit assemblies covering a range of diameters.

The results are given in Table 4 where it can be clearly seen that line spacings of <5 mm are undesirable.

TABLE 4

| Ball Unit Diameter (mm) | Line Spacing (mm) | Applied Force (kg) | Power Loss W/kg B = 1.7T, 50Hz Initial | Final | % Loss Reduction |
|---|---|---|---|---|---|
| 12.7 | 10 | 4.55 | 0.974 | 0.930 | 4.52 |
| | 7.5 | | 0.974 | 0.918 | 5.75 |
| | 6 | | 0.976 | 0.920 | 5.70 |
| | 5 | | 0.974 | 0.924 | 5.07 |
| | 3.75 | | 0.974 | 0.931 | 4.42 |
| | 3 | | 0.976 | 0.942 | 3.45 |
| 19.1 | 10 | 4.68 | 0.975 | 0.916 | 6.02 |
| | 7.5 | | 0.975 | 0.918 | 5.81 |
| | 6 | | 0.976 | 0.918 | 5.91 |
| | 5 | | 0.975 | 0.912 | 6.5 |
| | 3.75 | | 0.975 | 0.924 | 5.23 |
| | 3 | | 0.976 | 0.937 | 3.99 |
| 25.4 | 10 | 5.86 | 0.992 | 0.941 | 5.07 |
| | 7.5 | | 0.993 | 0.937 | 5.64 |
| | 6 | | 0.984 | 0.931 | 5.38 |
| | 5 | | 0.992 | 0.950 | 4.2 |
| | 3.75 | | 0.993 | 0.960 | 3.26 |
| 31.8 | 10 | 6.14 | 0.988 | 0.934 | 5.5 |
| | 7.5 | | 0.986 | 0.925 | 6.2 |
| | 6 | | 0.990 | 0.933 | 5.68 |
| | 5 | | 0.988 | 0.939 | 5.02 |
| | 3.75 | | 0.986 | 0.940 | 4.7 |
| 39.7 | 10 | 6.48 | 0.984 | 0.934 | 5.15 |
| | 7.5 | | 0.987 | 0.936 | 5.23 |
| | 6.0 | | 0.981 | 0.934 | 4.86 |

EXAMPLE 3

Further examples of loss reduction achieved for samples domain refined employing various ball unit assemblies and applied force values with the stress line spacing being 10 mm, are given in Table 5 where it can be seen that loss reduction values of up to 9.65% are achieved.

TABLE 5

| Ball Unit Diameter (mm) | Line Spacing (mm) | Applied Force (kg) | Power Loss W/kg B = 1.7T, 50Hz Before | After | % Loss Reduction |
|---|---|---|---|---|---|
| 19.1 | 10 | 5.21 | 1.089 | 1.021 | 6.24 |
| 31.8 | 10 | 5.55 | 1.095 | 1.001 | 8.58 |
| | | | 1.037 | 0.974 | 6.08 |
| | | | 1.092 | 1.026 | 6.04 |
| | | | 1.034 | 0.969 | 6.29 |
| 19.1 | 10 | 4.61 | 1.064 | 1.008 | 5.26 |
| | | 5.21 | 1.115 | 1.053 | 5.56 |
| | | 5.21 | 1.057 | 0.955 | 9.65 |
| | | 5.21 | 1.000 | 0.936 | 6.4 |
| 12.7 | 10 | 4.56 | 1.069 | 0.988 | 7.58 |
| | | 4.56 | 1.108 | 1.007 | 9.11 |
| | | 4.86 | 0.987 | 0.929 | 5.88 |
| | | 4.86 | 0.999 | 0.941 | 5.81 |
| 19.1 | 10 | 5.21 | 0.994 | 0.927 | 6.74 |

EXAMPLE 4

Insulation measurements were carried out on numerous samples domain refined using ball units of various diameters, various line spacings and applied force values higher than those which would normally be employed.

Samples were treated using resin bonded and stainless steel backing plates.

The results of insulation measurements are given in Table 6 where it can be seen that in all cases excellent insulation resistance was maintained after treatment.

TABLE 6

| Ball Diameter (mm) | Applied Force (kg) | Line Spacing (mm) | Insulation Resistance % tests >10r | >25r | Comments |
|---|---|---|---|---|---|
| 12.7 | 5.15 | 5 | 100 | 100 | |
| | | 3.75 | 100 | 100 | |
| | | 3 | 100 | 100 | |
| 19.1 | 4.58 | 5 | 100 | 100 | Resin Bonded |
| | | 3.75 | 100 | 100 | Backing |
| | | 3 | 100 | 100 | Plate |
| 19.1 | 5.21 | 5 | 100 | 100 | |
| | | 3.75 | 100 | 100 | |
| | | 3 | 100 | 100 | |
| 25.4 | 6.47 | 5 | 100 | 100 | |
| | | 3.75 | 100 | 100 | |
| | | 3 | 100 | 100 | |
| 31.8 | 6.74 | 10 | 100 | 100 | |
| | | 7.5 | 100 | 100 | |
| | | 6 | 100 | 100 | |
| 39.7 | 7.08 | 10 | 100 | 100 | |
| | | 7.5 | 100 | 100 | |
| | | 6.0 | 100 | 100 | |
| 19.1 | 5.21 | 5 | 100 | 100 | Stainless |
| | | 3.75 | 100 | 100 | Steel Backing |
| | | 6 | 100 | 100 | Plate |

It will be appreciated that the foregoing is merely exemplary of methods and apparatus in accordance with the invention and that modifications can readily be made thereto without departing from the true scope of the invention,

I claim:

1. An apparatus for effecting domain refinement of electrical steels comprising:

a supporting structure;

an array of rotatable members mounted within said supporting structure, adjacent ones of said rotatable members being spaced by a first distance relative to each other;

means for moving said array of rotatable members into direct contact with a surface of a piece of electrical steel to create lines of local plastic deformation which extend substantially across the width of the piece of electrical steel to effect domain refinement thereof, said first distance being such that a distance between adjacent lines of local plastic deformation is at least 5 mm;

means for imparting relative linear movement between said rotatable members and said piece of electrical steel; and resilient biasing means between said rotatable members and said supporting structure for urging said rotatable members towards a piece of electrical steel to be locally plastically deformed.

2. The apparatus as claimed in claim 1, further comprising means for periodically moving the piece of electrical steel relative to said rotatable members when the rotatable members are out of contact with the piece of electrical steel.

3. The apparatus as claimed in claim 1, further comprising means for continuously moving the piece of electrical steel relative to said rotatable members.

4. The apparatus as claimed in claim 1, wherein each of said rotatable members comprises a ball having a diameter of at least 10 mm and a bearing race within which said ball is supported, said resilient biasing means being disposed between said bearing race and said supporting structure.

5. The apparatus as claimed in claim 4, wherein each said ball is formed of chrome steel.

6. The apparatus as claimed in claim 4, wherein each said ball is formed of silicon nitride.

7. The apparatus as claimed in claim 4, wherein the diameter of each ball ranges between 10 mm and 50 mm.

8. The apparatus as claimed in claim 7, wherein the diameter of each ball ranges between 12 m and 32 mm.

9. The apparatus as claimed in claim 1, further comprising a substrate for supporting the piece of electrical steel.

10. The apparatus as claimed in claim 1, wherein said rotatable members are spaced relative to each other such that the distance between adjacent lines of local plastic deformation is between 5 mm and 10 mm.

* * * * *